United States Patent [19]

Cox

[11] 4,338,806

[45] Jul. 13, 1982

[54] THEFT DETERENT LOCK

[75] Inventor: Roy L. Cox, Greenville, N.C.

[73] Assignee: Frank Catricola, New York, N.Y. ; a part interest

[21] Appl. No.: 215,035

[22] Filed: Dec. 10, 1980

Related U.S. Application Data

[63] Continuation-in-part of Ser. No. 156,186, Jun. 3, 1979, abandoned.

[51] Int. Cl.[3] ..... E05B 9/04; E05B 15/16

[52] U.S. Cl. ..... 70/417; 70/422; 70/373

[58] Field of Search ..... 70/417, 422, 370, 372, 70/373, 374

[56] References Cited

U.S. PATENT DOCUMENTS

| | | | |
|---|---|---|---|
| 16,123 | 7/1825 | Schorwald | 70/417 |
| 265,474 | 10/1882 | Voll | 70/370 |
| 1,629,172 | 5/1927 | Murphy | 70/370 |
| 2,138,856 | 12/1938 | Harp | 70/422 |
| 3,899,907 | 8/1975 | Prahl | 70/370 |
| 4,222,253 | 9/1980 | Peitsmeier | 70/417 |

FOREIGN PATENT DOCUMENTS

| | | | |
|---|---|---|---|
| 2415184 | 8/1979 | France | 70/417 |
| 197711 | 11/1977 | Switzerland | 70/417 |

*Primary Examiner*—Robert L. Wolfe

*Attorney, Agent, or Firm*—Arthur T. Fattibene

[57] ABSTRACT

A theft proof lock which includes a protective sleeve rotatively disposed relative to a lock cylinder so that the protective sleeve is free to rotate whenever a torque or turning movement is imparted thereto by one attempting to tamper with the lock to secure against unauthorized access to the lock secured premises and thereby prohibiting such tampering from defeating the lock.

20 Claims, 13 Drawing Figures

THEFT DETERENT LOCK

RELATED APPLICATION

This application is a continuation-in-part application of my co-pending application Ser. No. 156,186 filed June 3, 1979, and now abandoned entitled A Theft Deterent Lock.

PROBLEM

A serious problem currently exists with respect to the ease by which unauthorized persons can sometimes gain access to secured premises which are protected by certain cylinder or tumbler type locks. Heretofore, such cylinder or tumbler type locks are generally installed on a door so that the face of the cylinder is disposed to the outside of the door and which cylinder is secured by screw type fasteners to the door from the back side of the door. Would be burglars and/or authorized persons have developed a technique whereby such locks can be easily defeated thereby permitting such persons to gain access to the premises secured thereby. The technique developed to defeat such lock installations is that the would be thief will grip the face plate of the cylinder extending to the front of the door with a suitable gripping tool and by applying a torque or turning movement back and forth will shear the screws or fasteners securing the lock cylinder to the door. Once the screws securing the lock cylinder to the door have been sheared, the thief can then simply pull the entire cylinder out of the door and thus defeat the lock.

OBJECTS

An object of this invention is to provide a deterent to a tumbler or cylinder type lock which prohibits a would be thief from shearing the fasteners by which the lock is secured to a door and thereby prohibiting such person from defeating the lock.

Another object resides in the provision whereby a cylinder or tumbler type lock can be rendered theft resistant in a relatively simple and expedient manner.

Another object resides in the provision whereby a known type of cylinder or tumbler type lock can be rendered theft proof without altering the construction of the locking mechanism per se of a given lock.

Another object resides in the provision of a theft deterent lock which can be readily assembled and installed with conventional lock mechanisms and applied to a door in a conventional manner.

BRIEF SUMMARY OF THE INVENTION

The foregoing objects and other features and advantages are attained by a lock assembly which is rendered theft proof by the inclusion of a protective sleeve which circumscribes the lock cylinder so as to be rendered readily rotatable relative thereto. The protective sleeve includes a face plate arranged to extend in the plane of the door. The protective sleeve is extended into a bore or lock opening formed in the door and provides the housing for the lock cylinder or tumbler. A lock nut is threaded to the remote end of the sleeve to secure the lock cylinder within the protective sleeve. The arrangement is such that the protective sleeve is mounted to rotate relative to the lock cylinder when a torque or turning movement is applied to the exposed face of the sleeve. The lock is secured to the door or to the back plate of the latch component of the lock by suitable fasteners such as screws. With the protective sleeve rotatably mounted relative to the lock cylinder a turning or torque movement applied to the sleeve will merely result in the protective sleeve being rotated relative to the lock cylinder, thus preventing the torque force being transmitted to the screw fasteners securing the lock to the door. As a result, a would be thief cannot shear the fasteners which secure the lock to the door in the manner heretofore developed by such persons to gain unauthorized access to a secured premise. The lock thus defined can be applied or adapted to any door thickness by the application of appropriate door spacers.

A feature of this invention resides in the provision of a protective sleeve circumscribing the lock cylinder so as to be rendered rotatable relative thereto.

Another feature resides in that the lock assembly including the protective sleeve can be fitted to any desired door size by the utilization of appropriate spacers.

Another feature resides in the provision that the protective sleeve can be readily applied to existing locks simply and quickly.

Another feature resides in the provision that the theft deterent lock is relatively simple in construction and positive in operation, and is relatively inexpensive to fabricate.

Other features and advantages will become more readily apparent when considered in view of the drawings and specifications in which.

DETAIL DESCRIPTION

Figure 1:
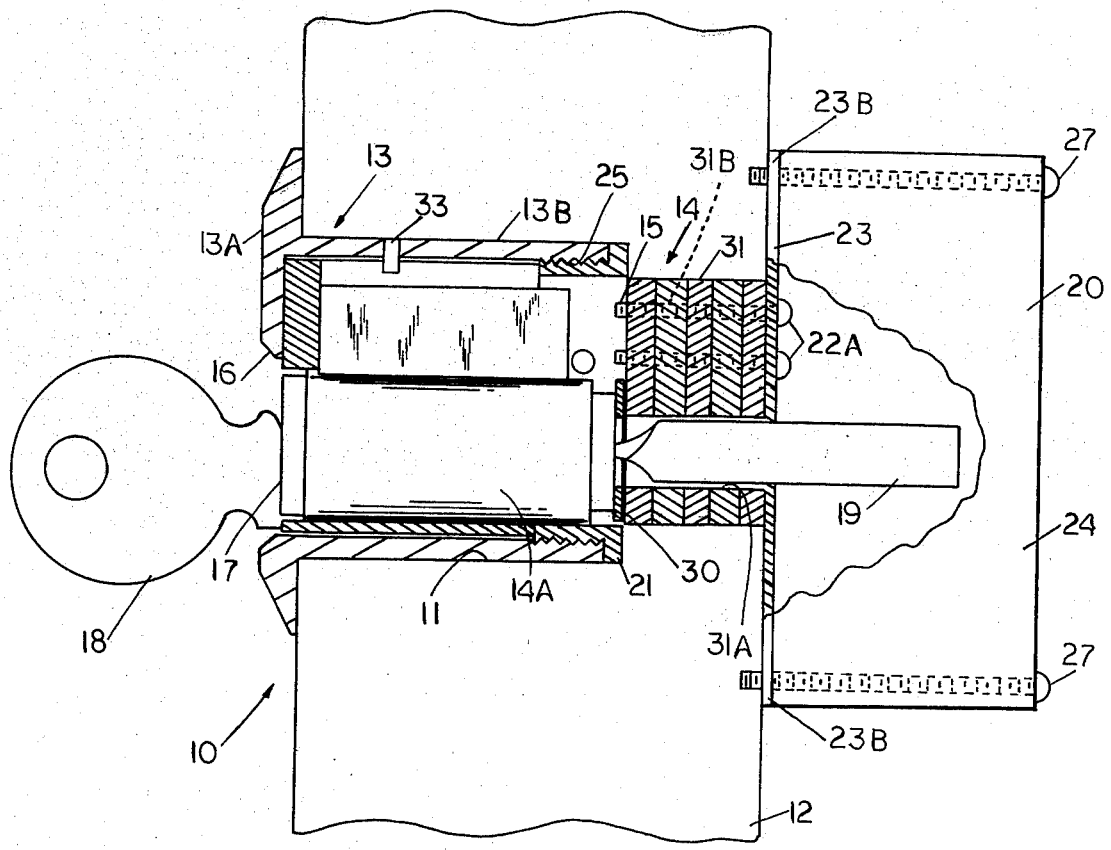
FIG. 1 is a cross sectional view of a lock assembly embodying the present invention.
Figure 8:
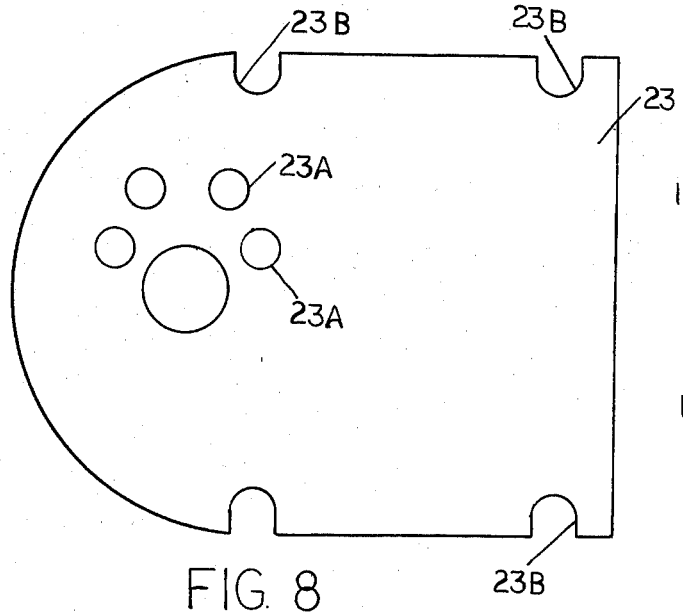
FIG. 8 is a detail view of the back plate of the latch mechanism.

Referring to the drawings there is shown in FIG. 1 a tumbler or cylinder type lock 10 embodying the present invention. The lock assembly 10 is of the cylinder type locks which are installed in a bore or opening 11 which extends through a door or closure 12 and to which the lock is secured. The lock assembly 10 comprises a protective sleeve 13 which includes a face plate 13A and a connected sleeve body 13B. It will be noted that the sleeve body 13B has an external diameter by which it can be readily fitted into the bore or opening 11 in the door 12. As shown, the face 13A has a diameter greater than that of the opening so that the outer periphery of the face plate 13A defines a flange by which it abutts against the plane of the door 12.

Disposed within the sleeve body 13B is the lock cylinder means 14. It will be understood that the lock cylinder means 14 may comprise the lock mechanism of known construction per se or it may comprise an adaptor for receiving a particular type of lock mechanism. As there are several known manufacturers of lock mechanisms, the illustrated embodyment discloses an adaptor 15 which is fitted into the sleeve body 13B and which adaptor 15 is arranged to receive a particular lock cylinder or mechanism 14A which includes the tumblers or cylinders of the lock mechanism per se.

The lock mechanism 14A per se includes a housing which has a keyway or key slot 17 for receiving a key 18 and the tumblers or cylinders associated therewith (which are not illustrated as such lock mechanism are well known). Associated with the lock mechanism 14A is the turn shaft 19 which connects to the latch mechanism 20 for effecting the operation of the locking latch when the key is turned.

The face plate 13A is provided with an opening 16 which is disposed in alignment with the keyway 17. The remote end of the sleeve body 13B is internally threaded at 25 for receiving a lock nut or ring 21 by which the lock mechanism 14A is secured within the sleeve body 13B.

The arrangement is such that the protective sleeve 13B and its associated lock ring or nut 21, when fitted to the door is free to rotate relative to the lock mechanism 14A or adaptor 15; in the event an applied turning movement is imparted to the front flange or plate 13A.

As shown, the lock assembly 10 described is secured to the door by a plurality screw or bolt type fastener 22A which are threaded into tapped holes 22 formed in the adaptor body 15. In the illustrated embodiment, four such tapped holes 22 are noted in the adaptor body 15. The back plate 23 of the latch assembly 24 is provided with appropriate fasteners holes 23A so that the securing fasteners 22A can be extended through the back plate 23 to secure the lock assembly to the door.

In accordance with this invention the back plate 23 is formed of a metal plate having a plurality of tapped or threaded holes or notches 23B. It will be noted that the tapped or threaded holes or notches 23B are disposed in aligment with the holes formed in the latch housing through which the screws or fasteners 27 are extended. The arrangement is such that the latch housing 24 connected to the inside of the door can be positively secured to the metallic latch plate 23 rather than being screwed directly to the door. With the construction described, the lock assembly 10 can be securely fastened to the door without having to have the screw threaded into the surface of the door.

As best seen, in FIG. 4 to 7, the adaptor 15 comprises a component part having a body portion which is sized to be received within the tubular sleeve 13B. The adaptor body is provided with a reduced rear end portion 15A which has extending parallel to its longitudinal axis a plurality of tapped holes 22. The adaptor body is provided with a longitudinal extending bore 15B communicating with a longitudinal extending slot 15C. Thus, the adaptor is shaped to accommodate the locking mechanism 14A which includes the keyway 17 and associated lock tumblers or cylinders. The keyway portion of the lock mechanism is snuggly received in the bore 15B and the tumbler portion of the lock mechanism 14A is received in slot 15C. If desired, a washer 30 is fitted adjacent to the back of the lock assembly between it and the back plate 23.

In order to adapt the described lock assembly to a door of given thickness a plurality of shims or spacers are interposed in contiguous relationship to the rear portion of the lock assembly. Several of such spacers 31 are shown in FIG. 1. Spacers 31 are utilized in the event that the door or closure thickness is greater than the length of the tubular sleeve 13B. It will be understood that each spacer 31 is provided with an opening 31A therein through which the lock shaft 19 is extended. The respective spacers 31 are also provided with a series of holes 31B through which the fasteners 27 are extended to secure the adaptor body to the back plate 23 of the latch assembly. Thus, one or more spacers 31 may be added to the end of the lock assembly as may be necessary to take up the difference between the length of the sleeve 13B and the depth of the hole 11 formed in the door which is equal to the door thickness.

Figure 9:
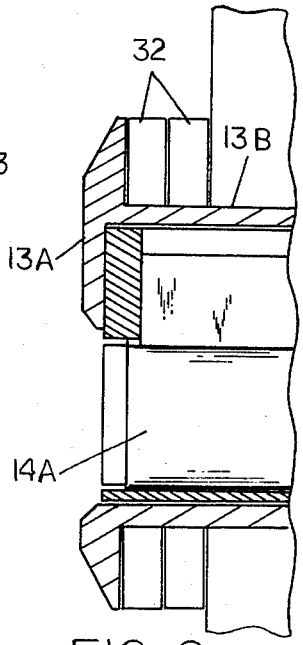
FIG. 9 is a fragmentary sectional view of a modified form of the invention.
Figure 3:
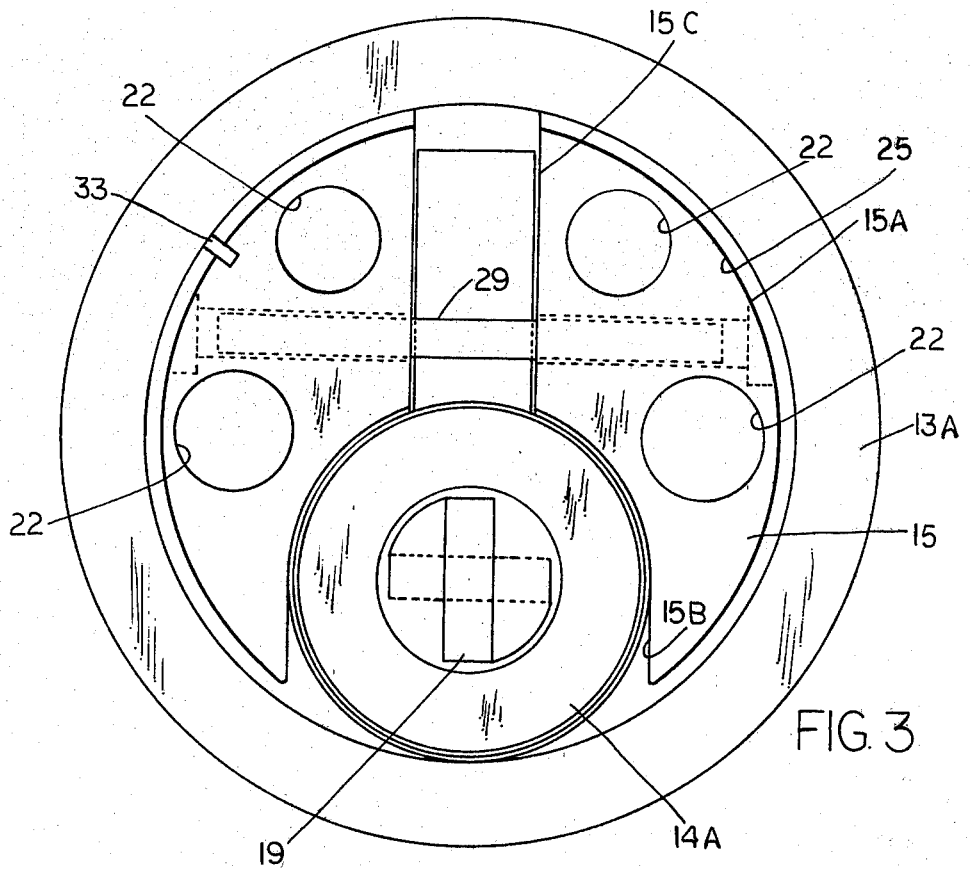
FIG. 3 is an enlarged rear end view of the rotatable sleeve with lock mechanism in place.
Figure 2:
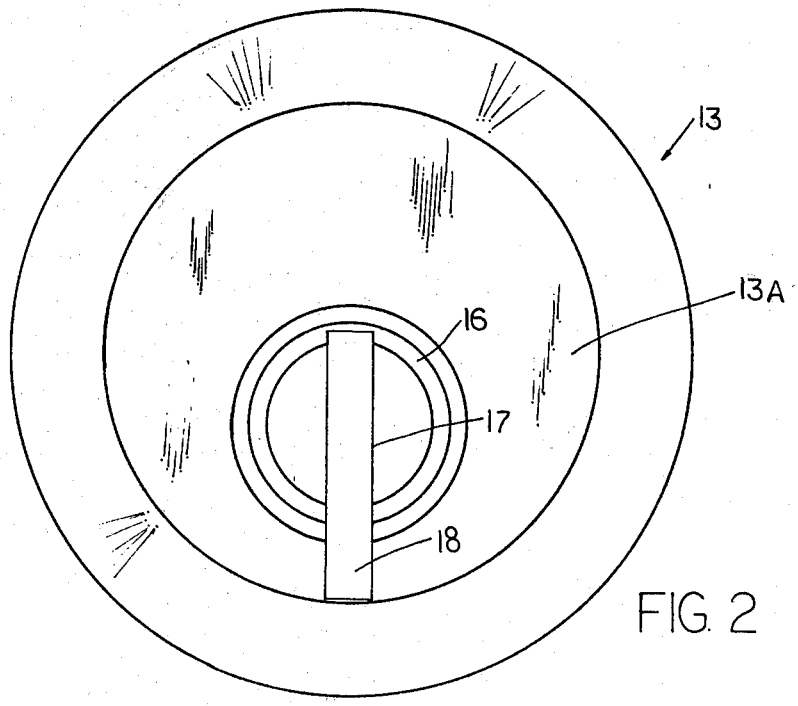
FIG. 2 is an enlarged front view of the lock assembly of FIG. 1.
Figure 5:
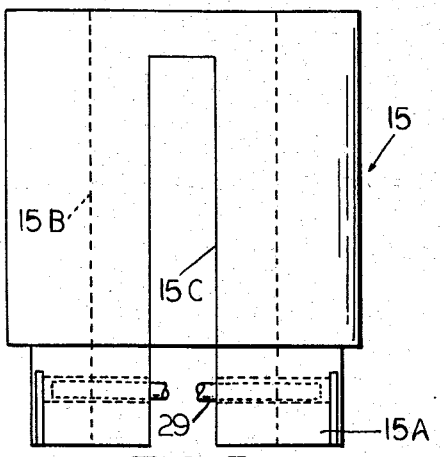
FIG. 5 is a top view of FIG. 4.
Figure 4:
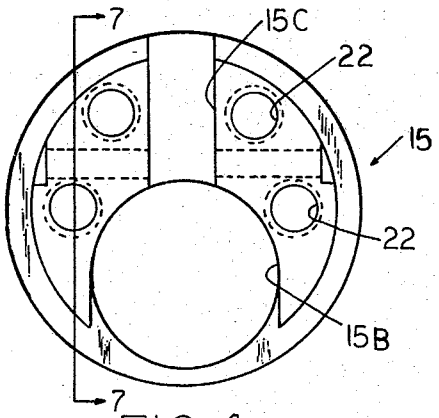
FIG. 4 is a detail rear view of the adaptor for the lock mechanism.
Figure 6:
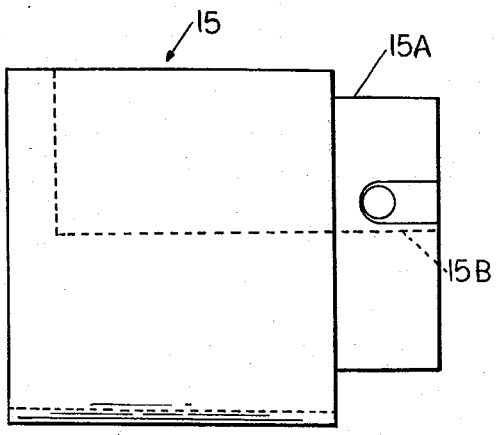
FIG. 6 is a side view of FIG. 4.
Figure 7:
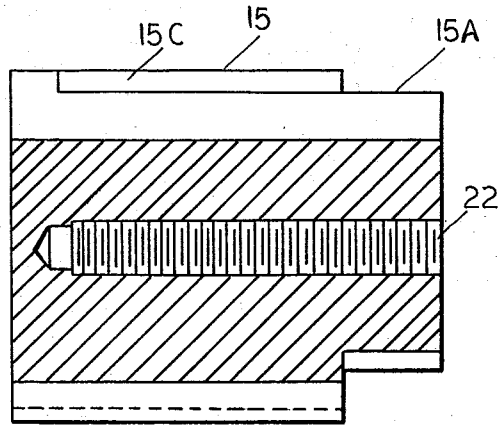
FIG. 7 is a sectional view taken along line 7—7 of FIG. 4.

In the event that the thickness of the door 12 is less than the length of the sleeve body 13A, a plurality of spacer rings 32 are disposed between the front face 13A of the sleeve 13 and the front of the door 12 as seen in FIG. 9. The number of spacer 32 rings required will depend upon the size or width of the spacer rings 32 and the difference between the door thickness and the length of the sleeve body 13B.

To predeterminately position the sleeve 13 relative to the adaptor or cylinder lock assembly so as to maintain the opening 16 in the face plate 13A in alignment with the keyway 17, the sleeve 13 is pinned or releasably secured to the adaptor 15 by a frangible shear pin 33. The arrangement is such that the frangible pin 33 is sufficient to maintain the sleeve 13 fixed to the adaptor 15, but which pin 33 will shear when a predetermined amount of torque is applied to the sleeve 13 when it is being tampered with by an unauthorized person.

It will be understood that the sleeve including its face plate 13A may be formed of a hardened metal such as hard steel which will resist drilling.

From the foregoing description, it will be apparent that the utilization of sleeve 13 which is rotatably disposed relative to the lock cylinder or assembly 14A or its adaptor 15 will effectively defeat a trespassers' technique of shearing the screws or fasteners 22A by a twisting or torque face applied to the face plate of such cylinder or tumbler type locks.

Figure 10:
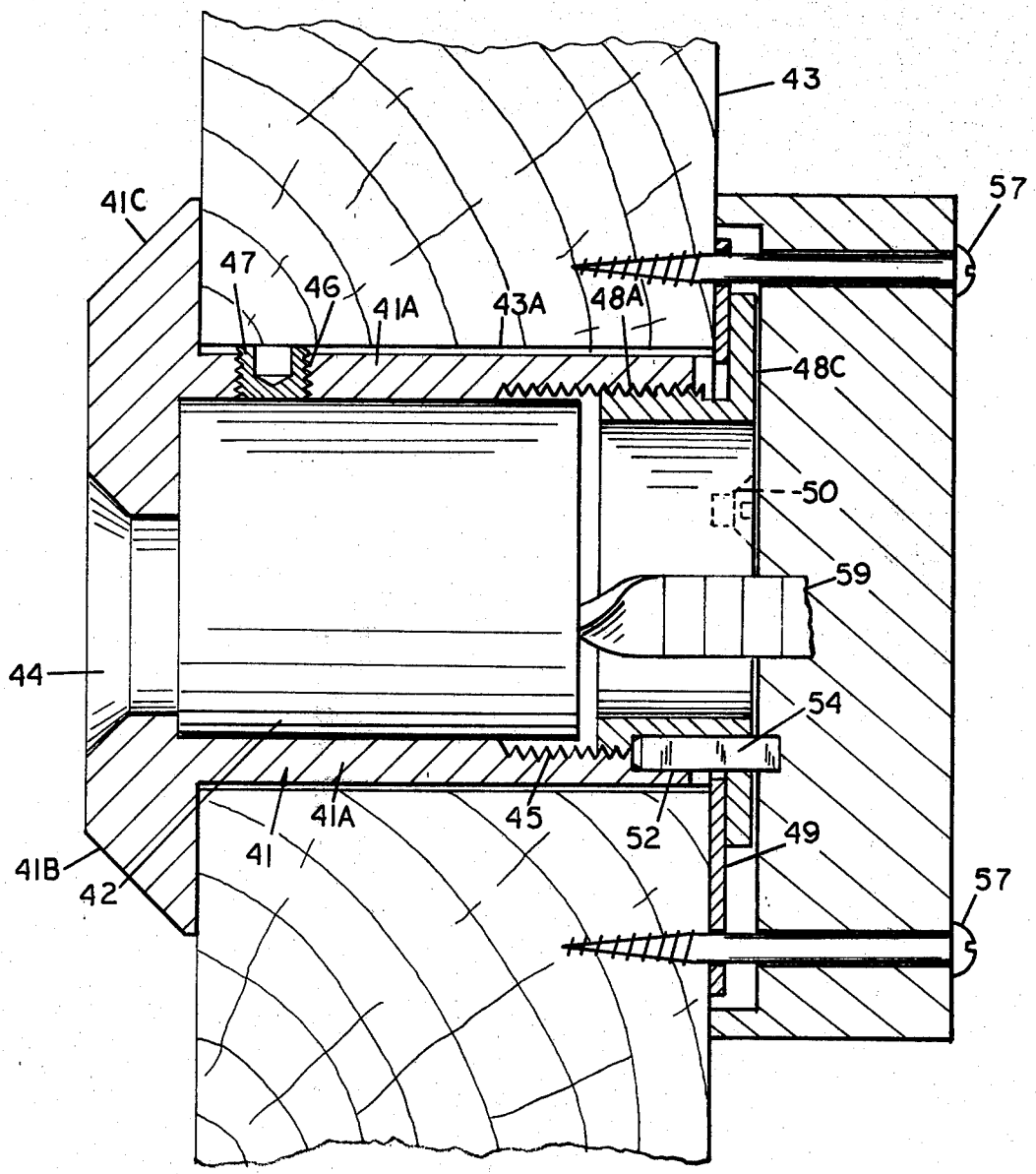
FIG. 10 is a sectional side view of a modified embodiment.
Figure 12:
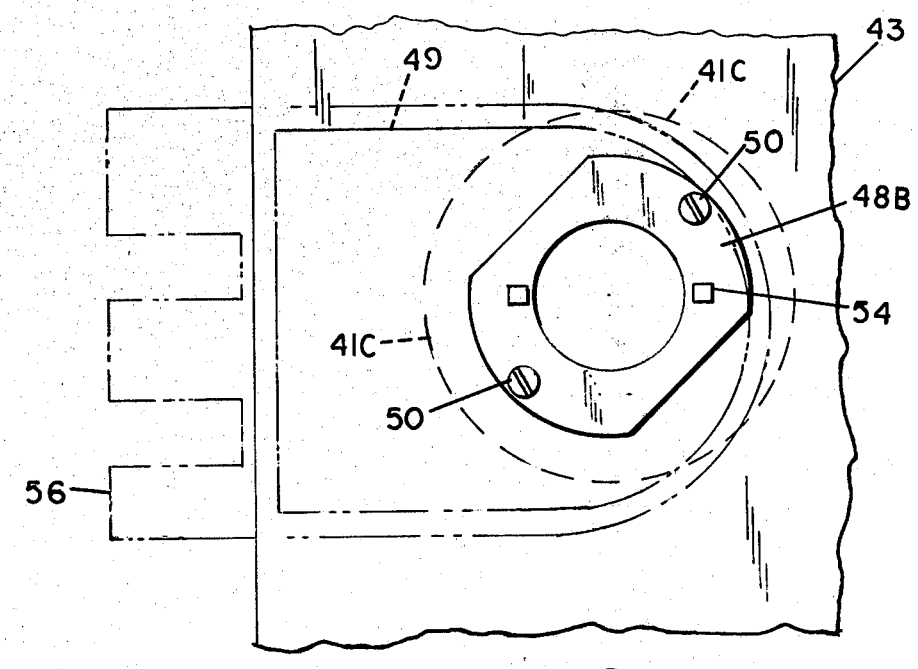
FIG. 12 is a rear view of the lock deterent assembly of FIG. 10.
Figure 11:
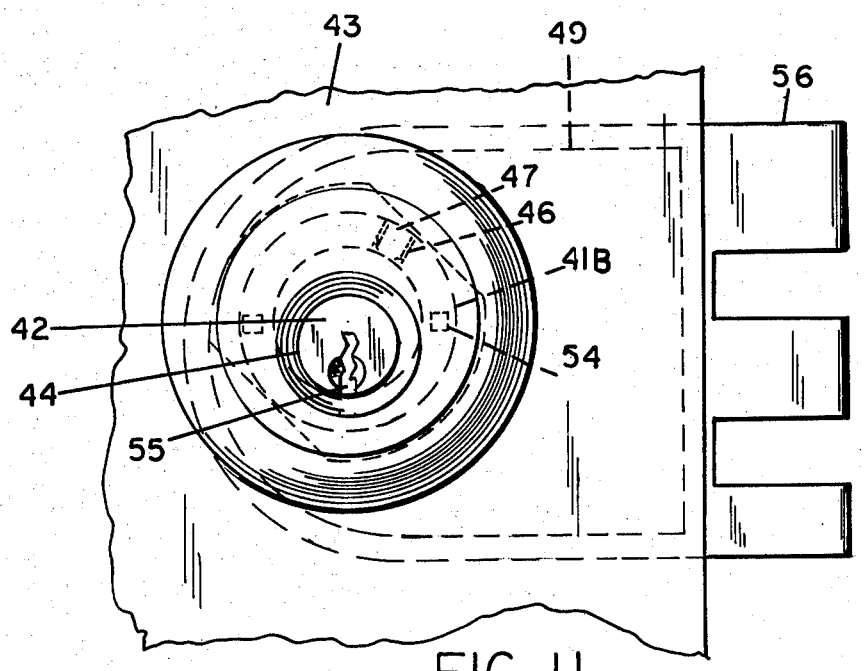
FIG. 11 is a front view of the lock deterent assembly of FIG. 10.
Figure 13:
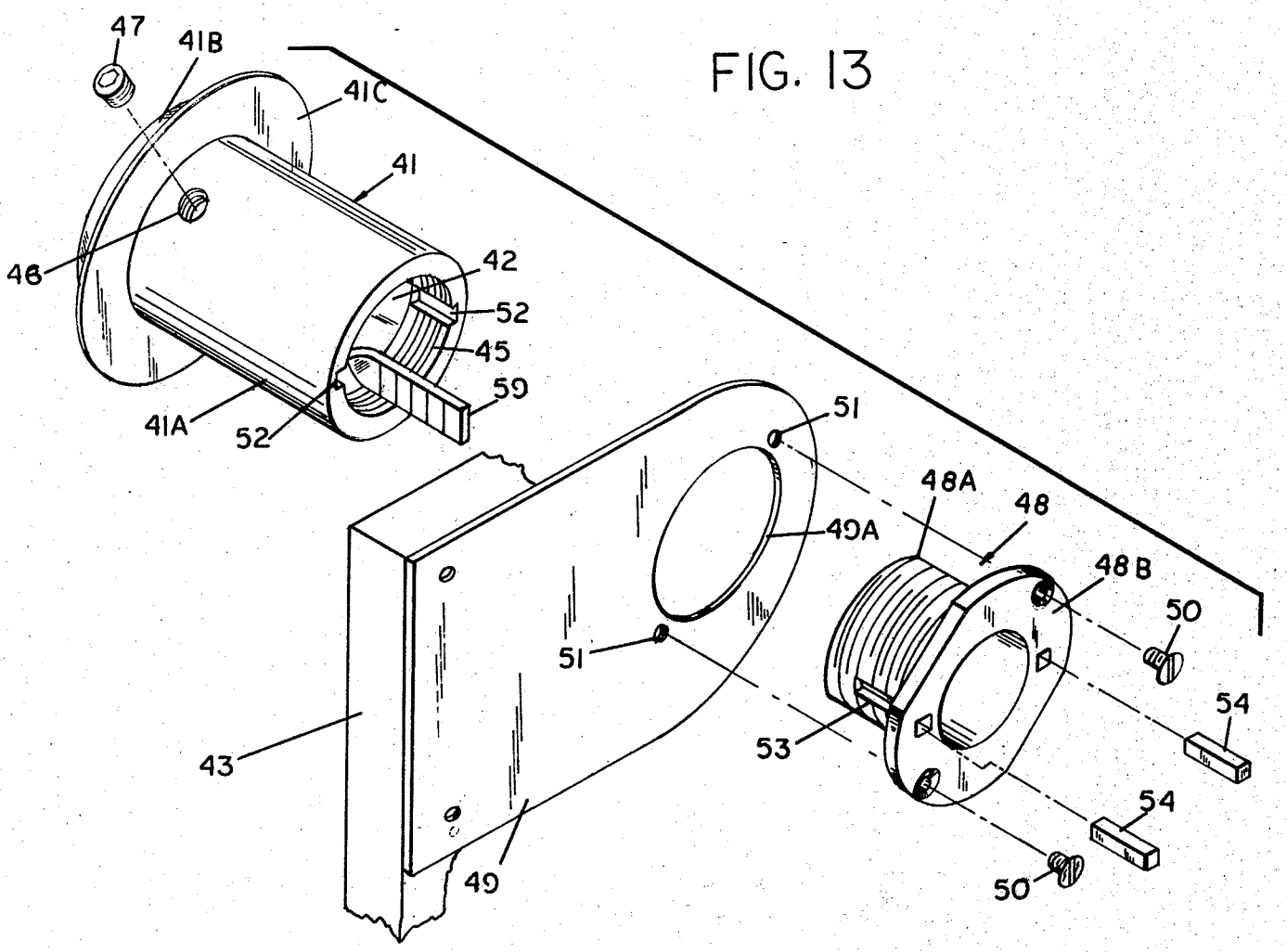
FIG. 13 is an exploded perspective view of the component parts of the block deterent assembly of FIG. 10.

FIGS. 10 to 13 illustrate a modified form of the invention. In this embodiment the theft deterent lock assembly or mechanism 40 includes a sleeve 41 having a cylindrical sleeve body 41A adapted, receive or house the lock mechanism 42. The lock mechanism as hereinbefore described comprises a conventional cylindrical or tumbler type lock mechanism of well known construction. Connected to the front end of the sleeve 41 is a face plate 41B having a radially extending flange portion 41C which is adapted to abutt in the plane of a door or closure 43 on one side thereof. The face plate 41B is provided with an opening 44 which is disposed in alignment with the key slot 45 of the lock mechanism 42. As shown, the rear or other end of the sleeve body 41B is provided with an internal threaded portion 45. It will be understood that the external diameter of the sleeve body 41A is sized so as to be received in a bore or opening 43A formed in the door 43. The arrangement is such that the lock cylinder or mechanism 42 is fitted within the sleeve body so that it may rotate relative to the lock mechanism 42 if a turning or twisting moment is imparted to the face plate 41b by a would be thief, as hereinbefore described. To further deter from imparting a torque moment onto the face plate 41B, the circumferential portion of the face plate 41B may be tapered or inclined as best seen in FIG. 10. If desired, the sleeve body 41A may be provided with a tapped hole 46 for receiving a set screw 47 for releaseably holding the lock cylinder 42 in place within the sleeve body 41A.

Mated to the rear end of the sleeve body 41A to retain the lock cylinder 41 in place is a retainer nut 48. As shown, the retainer nut 48 has a threaded portion 48A which is adapted to be threaded or mated to the threaded end 45 of the sleeve body. The retainer nut 48 is also provided with a radial flange portion 48B which is adapted to abutt in the plane of the door 43 on the opposite side thereof. In the illustrated embodiment a mounting plate 49 is secured to the door, and which mounting plate is provided with a hole 49A for receiving the nut 48A.

In the foregoing description, it will be noted that the component parts can be readily assembled by fitting the sleeve 41 with the lock mechanism in place therein into the door opening 43A from one side thereof, and fitting and mating the retainer nut 48 thereto from the other side of the door 43. The retainer nut 48 is then secured to the door by suitable fasteners such as screws or bolts 50 that thread into tapped holes 51 formed in the mounting plate 49, or if no mounting plate is used, into the door 43.

In accordance with this invention, a coupling means is provided to couple the sleeve body 41A to the nut 48A so that both can turn in unison in the event a turning moment is imparted to the face plate 41B of the sleeve 41. As shown, the internal portion of the sleeve body 41A is provided with one or more keyways 52 extending longitudinally. The nut 48A is also provided with a complementary keyway 53 which when mated to the sleeve keyway 52 define a channel for receiving a pin 54. It will be understood that the keyways 52,53 and associated pin 54 may be either round or polygonical in cross section. With the pins 54 inserted in the channel defined by the complementary keyways 52 and 53 the sleeve 41 and nut 48 are coupled to rotate in unison when a torque is applied to the face plate.

Bolted to the mounting plate is the latch mechanism 56 which contains the latch bolt (not shown) and which receives the turn shaft 59, in a well known manner. As shown in FIG. 10, suitable bolts 57 secure the latch mechanism 56 to the mounting plate or door.

In operation, when a would be thief attempts to apply the technique of twisting or turning the face plate 41B of the lock assembly in an effort to defeat the lock, as hereinbefore described, the sleeve and nut coupled thereto will be turned in unison accordingly. As best, such turning moment may effect the shearing of the fasteners 50 which secure the nut to the mounting plate 49 or door 43. However, with the construction described, the would be thief cannot remove the sleeve 41 or lock mechanism 42 from the door. Thus, the security afforded by the lock assembly is maintained in tact. Because of the flange portion 41C of the sleeve 41 and the flange portion 48B of the retainer 48 sandwiches the door therebetween, it will be noted that the lock assembly cannot be pushed in or pulled out, even if one is successful in shearing the fasteners 50.

While the invention has been described with respect to a specific embodiment of the invention, it will be readily understood and appreciated that variations and modifications may be made without departing from the spirit or scope of the invention.

I claim:

1. A theft deterent lock comprising a lock cylinder means having a keyway adapted to be received in a bore extending through a door, a protective sleeve circumbscribing said lock cylinder means, said sleeve having a face plate adapted to extend in the plane of the door, said face plate having an opening therein adapted to be disposed in alignment with the key way of said lock cylinder means, a lock nut connected to the end of said sleeve remote from said face plate for securing said lock cylinder means within said sleeve between said face plate and said lock nut, said sleeve and connected lock nut being free to rotate relative to said lock cylinder means, and means for securing said lock cylinder means to the door within the bore therein whereby said protective sleeve prohibits one from tampering with said lock cylinder means.

2. A theft deterent lock as defined in claim 1 and including spacer means for accommodating said lock to doors of varying thickness.

3. A theft deterent lock as defined in claim 2 wherein said spacer means comprises a ring adapted to circumscribe said sleeve for adapting said lock to a door having a thickness which is less than the length of said sleeve.

4. A theft deterent lock as defined in claim 2 wherein said spacer means comprises a washer disposed contiguous to said cylinder lock means for adapting said lock to a door having a thickness which is greater than the length of said sleeve.

5. A theft deterent lock as defined in claim 1 and including a frangible shear pin for releasably securing said sleeve to said cylinder means whereby said frangible shear pin is adapted to fracture upon the application of a predetermined amount of torque force on said sleeve.

6. A theft deterent lock as defined in claim 1 and including a set pin for securing said lock nut to said sleeve in the operative position thereof.

7. A theft deterent lock as defined in claim 1 wherein said securing means concludes a latch assembly including a back plate adapted to engage the inside surface of a door, a plurality of screw means securing said lock cylinder means to said back plate, and a latch body fitted to said back plate, and screw fasteners securing said latch body to said back plate, said back plate having tapped holes for receiving said screw fasteners.

8. A theft deterent lock as defined in claim 1 wherein said lock cylinder means comprises an adaptor housing having a bore therein, and a tumbler assembly adapted to be received in the bore of said adaptor housing, said housing having a plurality of tapped holes formed in the end wall thereof for receiving screw fasteners by which said lock is secured to a door.

9. A theft deterent lock assembly comprising a protective sleeve having a tubular body and a connected front face, said front face defining a flange which circumscribes said tubular body whereby said sleeve is adapted to be received in a bore extending in a door with said flange abutting the outer surface of a door, said front face having an opening formed therein for receiving a key, an adaptor housing disposed within said tubular body, said adaptor housing having a bore, a tumbler assembly disposed in said bore, a lock nut thread to the end of said tubular body remote from said front face for securing said adaptor housing and tumbler assembly within said tubular body whereby said protective sleeve is free to rotate relative to said adaptor housing, said tumbler assembly having a keyway disposed in alignment with the opening in said face plate, and securing means for securing said adaptor housing to a door.

10. A theft deterent lock as defined in claim 9 wherein said securing means comprises a latch assembly and fasteners securing said lock assembly to said latch assembly.

11. A theft deterent lock assembly comprising a lock mechanism having a key slot, a protective sleeve circumscribing said lock mechanism whereby said sleeve is rendered rotatable relative to said lock mechanism, said sleeve having a face plate having an opening therein disposed in alignment with the key slot of said lock mechanism and said face plate being adapted to abutt contiguous to one side of a closure and a nut having a flange portion adapted to be disposed contiguous to the other side of a closure, means for connecting said sleeve to said nut whereby said sleeve and nut are adapted to rotate in unison when a turning moment is imparted to said face plate, and means for securing nut and connected sleeve in place to the closure.

12. A theft deterent lock assembly as defined in claim 11 wherein said connection means includes said sleeve has a threaded portion internally thereof adjacent one end, and said nut having an external threaded portion whereby said sleeve is threadedly connected to said nut, and coupling means for maintaining said sleeve and nut coupled together to rotate a unison when a turning moment or torque is applied to said sleeve.

13. A theft deterent lock assembly as defined in claim 11 and including a mounting plate adapted to be connected to said other side of the closure, and fastening means for securing said nut to said mounting plate.

14. A theft deterent lock assembly as defined in claim 12 wherein said threaded portion of said sleeve and lock have complementary keyways extending longitudinally thereof which are adapted to be disposed in alignment in the assembled position thereof, and said coupling means includes a pin extending into said aligned keyways for coupling said sleeve to said nut whereby the sleeve and nut are rotated in unison relative to said lock mechanism when a turning moment is imparted to said sleeve.

15. A theft deterent lock assembly as defined in claim 1 and including a means for detachably securing said sleeve to said lock mechanism.

16. A theft deterant lock mechanism comprising a means defining a sleeve adapted to be rotatably disposed to a lock cylinder, a retainer means for retaining said sleeve in position relative to the lock cylinder, and means coupling said sleeve means to said retainer means whereby said sleeve means and retainer means rotate in unison when a turning moment is imparted to said sleeve means, whereby said sleeve means and retainer means each include a flange portion for sandwiching there between the closure to be secured by said lock mechanism.

17. A theft deterent lock mechanism as defined in claim 16 and including fastening means for securing said retainer means to the closure.

18. A theft deterent lock mechanism comprising a means defining a sleeve adapted to be rotatably disposed to a lock cylinder, a retainer means for retaining said sleeve in position relative to the lock cylinder and means coupling said sleeve means to said retainer means whereby said sleeve means and retainer means rotate in unison when a turning moment is imparted to said sleeve means, and wherein said sleeve means and retainer means include complementary attachment means whereby said sleeve and retainer means are detacably connected.

19. A theft deterent lock mechanism for securing a closure of an access opening comprising a cylinder lock fitted in a bore formed in said closure, a sleeve means having a sleeve body defining a housing for said cylinder lock, said sleeve body being rotatably disposed relative to said lock, said sleeve means including a face plate connected to said sleeve body and extending radially outwardly therefrom defining a flange adapted to abutt in the plane of the closure on one side thereof, and the end of said sleeve body opposite said face plate being internally threaded; a retainer means having an externally threaded nut portion of said sleeve body, said nut portion having a flange portion adapted to abutt in the plane of said closure on the other side thereof, means for coupling said sleeve body to said nut so that said sleeve body and nut will rotate in unison when a turning moment is imparted to said sleeve body, fastening means for securing said retainer means to said closure, said face plate having an opening therein disposed in alignment with the key slot of said lock mechanism.

20. A theft deterent lock mechanism as defined in claim 19, wherein said coupling include means defining complementary key ways in said sleeve body and nut extending longitudinally thereof, and a pin inserted into said complementary key ways for torque coupling said sleeve body and nut.

* * * * *